United States Patent [19]

Geyer, Jr. et al.

[11] 4,364,889

[45] Dec. 21, 1982

[54] PROCESS FOR PREPARING A COTTON-LIKE RAYON FIBER

[75] Inventors: Charles J. Geyer, Jr., Berwyn; Ben E. White, Wayne, both of Pa.

[73] Assignee: Fiber Associates, Inc., Berwyn, Pa.

[21] Appl. No.: 150,094

[22] Filed: May 15, 1980

[51] Int. Cl.[3] ..... D01F 2/06

[52] U.S. Cl. ..... 264/188; 264/197; 536/61

[58] Field of Search ..... 264/188, 197; 536/101, 536/61

[56] References Cited

U.S. PATENT DOCUMENTS

| | | | |
|---|---|---|---|
| 3,720,743 | 3/1973 | Stevens et al. | 264/188 |
| 3,836,336 | 9/1974 | Yasui et al. | 264/188 |
| 3,875,141 | 4/1975 | Drisch | 264/184 |
| 4,121,012 | 10/1978 | Bockno | 264/188 |
| 4,163,840 | 8/1979 | Geyer et al. | 536/101 |
| 4,182,735 | 1/1980 | Costa et al. | 264/188 |
| 4,242,405 | 12/1980 | Bockno | 264/188 |
| 4,245,000 | 1/1981 | Bockno | 264/188 |
| 4,260,739 | 4/1981 | Geyer et al. | 536/61 |

FOREIGN PATENT DOCUMENTS

| | | | |
|---|---|---|---|
| 43-14180 | 6/1968 | Japan | 264/188 |

*Primary Examiner*—Jay H. Woo

*Attorney, Agent, or Firm*—Austin R. Miller

[57] ABSTRACT

An improved viscose rayon fiber is disclosed having a degree of polymerization of greater than about 500 and an alkali solubility of below about 7.5%, the fiber also exhibits a tenacity of about 5-6 grams per denier and a conditional elongation of between about 10-20%. This fiber exhibits increased toughness and increased wet strength when compared with prior art rayon fibers.

3 Claims, No Drawings

PROCESS FOR PREPARING A COTTON-LIKE RAYON FIBER

BACKGROUND OF THE INVENTION

This invention relates to high wet modulus fibers having enhanced wet strength and toughness properties so as to be similar in characteristics to cotton.

Some wet modulus fibers of the prior art were found to have certain shortcomings that limited their use. Many were brittle and were subject to fibrillation, and it was also found that these had low abrasion resistance and poor launderability characteristics.

Methods of producing viscose rayon staple from viscose containing a cellulose component of relatively high degree of polymerization are also known. These various known methods are conventionally referred to as "high or intermediate wet modulus fiber," and have some properties close to those of cotton when compared with conventional viscose rayon staple. However, heretofore known high wet modulus fibers still lacked one or more of the preferred properties of cotton such as high alkali resistance, high tensile tenacity and a suitable ratio of wet tenacity to conditioned tenacity. Also, heretofore known methods of production of high wet modulus fiber has been relatively low.

U.S. Pat. No. 2,732,279 of Tachikawa discloses a process for producing a rayon fiber which is stated as being comparable to cotton through the essential features of dissolving cellulose so as to permit the retention of a substantial proportion of intrinsic properties of the natural fiber and with a regeneration procedure which consists of microspinning dissolved cellulose under controlled conditions. However, the total process specifications of Tachiwaka of using a spinning bath of very low acid and low salts results in a fiber which is far from the characteristics of cotton.

U.S. Pat. No. 3,139,467 of Drisch et al carries forward the teachings of Tachiwaka et al in its recognition of the need for a high degree of polymerization (DP) in the fiber. Drisch et al further utilizes the concept of highly stretching the filaments while the fiber is still in the xanthate gel state which requires the utilization of a dilute acid spinning bath with a low salt content. Drisch et al further adds formaldehyde into the dilute bath which, as a result of crosslinking, causes the fiber to have some cotton-like properties but also causes the fiber to be very brittle, which is not at all cotton-like.

U.S. Pat. No. 3,277,226 of Bockno et al and U.S. Pat. No. 3,529,052 of Carney et al. each relate to the development of the so-called high wet modulus fibers, and for the first time there was prepared a synthetic fiber having a cotton-like wet strength, and that approached cotton in low water pick-up and low shrinkage characteristics without being excessively brittle. These fibers and processes were developments in tire cord technology which by virtue of well known viscose additives and high concentrations in the spinning bath of zinc salts yielded a very strong, tough and resilient fiber. The innovations resulted in a fiber with high wet strength, high wet modulus and low shrinkage which added to tire cord toughness and resilience. Nonetheless, these high wet modulus fibers were still somewhat deficient as compared to cotton in water stability and resistance to caustic, which is a good indicator of wet performance.

U.S. Pat. No. 3,434,913 of Bockno et al. and U.S. Pat. No. 3,494,996 of Stevens et al. relate to the preparation of viscose rayon fibers having high strength characteristics and a high wet modulus without being excessively brittle or fibrillatable. However, each of these patents following Drisch disclose the utilization of formaldehyde in the stretch bath which is now known to alter the characteristics of the fiber away from cotton, and introduce other undesirable properties.

With the advent of high wet modulus rayon fibers, toughness and particularly wet performance were substantially improved. High wet modulus rayon became reasonably competitive with cotton in factors including shrinkage, wear resistance, wet performance, and launderability. Accordingly, it was thus possible to place the high wet modulus rayon fibers in many end use fabric applications where rayon had been wholly unsatisfactory before. Examples include sheets and men's shirting fabric. In these applications, the high wet modulus rayon did approximate cotton insofar as wear, abrasion resistance, and launderability characteristics were concerned. For all practical purposes, these high wet modulus (HWM) rayon containing fabrics could withstand a number of launderings without serious deterioration of the fabric.

Nevertheless, cotton still held a real advantage over rayon in the above noted group of properties and also exhibited a decided advantage over rayon in many laboratory tests designed to simulate or predict real fabric performance.

The following Table shows the approximate ratings resulting from various laboratory evaluations of wear by various well known procedures.

TABLE

| | Reg. Rayon | HWM Rayon | Cotton |
|---|---|---|---|
| | Untreated Fabric Stoll Flat Abrasion | | |
| Conditioned | 85 | 95 | 120 |
| Wet | 20 | 30 | 75 |
| | Stoll Flex | | |
| Conditioned | 110 | 110 | 200 |
| Wet | 85 | 200 | 350 |
| | Accelerator % Weight Loss | | |
| Conditioned | 1.7 | 2.0 | 3.0 |
| Wet | 1.5 | 0.2 | 0.4 |
| | Solubility in 10% NaOH | | |
| % Dissolved | 12% | 8% | 6% |

One of the above properties which seems to indicate the toughness of the fiber is that of caustic solubility.

A further qualitative or semi-quantitative evaluation of wear is the appearance of fibrillations along fabric creases. Fibrillation becomes apparent in dyed fabrics and is manifested as a ligher colored fuzz on the fabric surface. This phenomenon appears long before the fabric itself shows a crease or a break. With respect to fabric fibrillation, high wet modulus rayons usually exhibit more fibrillation than do cotton fibers.

It is most important to note that in considering wear evaluation of fibers, fabrics deteriorate far more by washing or cleaning than they do by actual wearing. Accordingly, the behavior of the fiber and fabric in washing machines is more significant than what happens to the fabric while in actual use. By this modern criterion, cotton still has a small but significant advantage over the utilization of conventional rayon and high wet modulus rayon fabrics.

One additional quality which rayon showed at a disadvantage to cotton was in "cover", by which we mean that the same weight of cotton yarn seemed to occupy more volume than its equivalent rayon. By introducing a slight crimp to the rayon, and adding small quantities of delustrants to the rayon, one could make the rayon equivalent to cotton in this quality.

The above noted disadvantages of the utilization of rayon have now been overcome by the creation of a new rayon fiber which is fully equal to cotton in wet toughness, resistance properties and in cover, while maintaining all of the other desirable properties of high wet modulus rayon, namely, high strength conditions, good dyeability, high moisture regain, shrinkage resistance, superior carding properties and the superior spinning and weaving properties of high wet modulus rayon.

SUMMARY OF THE INVENTION

The present invention relates to novel rayon fibers which possess a balance of characteristics and properties which results in a fiber similar to cotton in all of the most important aspects.

In order to obtain the cotton-like rayon fiber of the present invention it is essential to utilize in a spinning step a highly homogeneous spinning solution which is made from cellulose in such a way that the original DP of the pulp used (1,000 or greater) is not reduced to a DP below that of the desired product. In the normal viscose making operation, this would result in a solution of such high viscosity that one would have great difficulty in operations of mixing, filtering, deaerating and pumping through the aging cellars.

It is further critical to achieve a highly homogeneous spinning solution and that the viscose solution be prepared in such a manner as to have little gel reformation. Also, the percentage of cellulose in the viscose solution is important and should be maintained at about from 6.0–9.0%.

In the spinning of the viscose solution, it is essential that a relatively high concentration of zinc salt be present in the coagulation bath along with a proper sulfuric acid concentration. That is, the coagulation bath should contain about 5.0–8.0% sulfuric acid, preferably 6.0–7.0%, and from about 3.0–5.0% of a zinc salt, preferably zinc sulfate.

It has been surprisingly found that where the degree of polymerization of the regenerated cellulose is above 500, the properties of the fiber spun approaches that of natural fiber, even when a spinning bath temperature is maintained at a temperature higher than 30° C.

DETAILED DESCRIPTION OF THE INVENTION

The development of a completely continuous viscose making system, including continuous steeping and mercerization, continuous xanthation and mixing, and continuous filtration and aging, such as disclosed in U.S. Pat. Nos. 4,037,039 and 4,163,840 and copending application Ser. No. 38,068, now U.S. Pat. No. 4,260,739 and incorporated herein by reference, has enabled us to make this new fiber in a practical manner.

In accordance with one embodiment of the present invention, a viscose containing at least 6.0% cellulose is used. The cellulose contained in the viscose should have a DP of at least 500, and preferably 600–700. The viscosity of the viscose at the time of spinning should range between 100 and 1,000 poises. The viscose is spun in a bath comprising about 5.0–8.0% sulfuric acid, and preferably 12–17% sodium sulfate and at least 3.0% zinc sulfate, preferably 3.0–4.0%. The bath can further contain small quantities of a modifying agent such as polyalkylene oxide, but should be free of formaldehyde. The temperature of the bath ranges is preferably between 30° and 40° C. The filaments obtained are stretched in a second hot dilute acid bath, preferably 125–135%.

The viscose compositions and respective spinning conditions are given in the following Examples.

| Viscose Composition: | EXAMPLE 1 Preparation of a non-crimped fiber | EXAMPLE 2 Preparation of a crimped fiber |
|---|---|---|
| Wood pulp source (% alpha cellulose) | 98 | 98 |
| % cellulose in viscose | 7.0 | 6.0 |
| % NaOH | 7.0 | 6.0% |
| $CS_2$ (Based on cellulose) | 35 | 32 |
| DP | 600 | 650 |
| Modifiers (based on cellulose) | 2% DMA +3% 15 D Phenol | 1% DMA +2% 15 D Phenol |
| Salt test | 7 to 10 | 7 to 10 |

If desired, a delustrant material may be added, such as, 0.25–1.0% $TiO_2$.

In the viscose making process, it is preferable that, in the steeping step, a high alpha wood pulp or its equivalent is utilized. The preferred conditions for performing the continuous steeping process are as disclosed and claimed in U.S. Pat. No. 4,037,039 and incorporated herein by reference.

Continuous xanthation follows in both the "dry" and slurry steps, followed by a mixing operation, as disclosed in U.S. Pat. No. 4,163,840 of several successive steps of addition of solvent (NaOH and $H_2O$), and bringing the xanthate solution to the desired cellulose and NaOH concentrations. If viscose modifiers, such as polyalkylene oxide or dimethylamine, are used they are added in the mixing stage.

The viscose is then passed through a continuous aging, filtration and deaeration operation under controlled conditions to insure the proper ripeness for the spinning operation according to a process such as described in our copending application Ser. No. 89,129 entitled "PROCESS FOR CONTINUOUS FILTRATION AND AGING OF XANTHATED ALKALI CELLULOSE".

A continuous process is particularly essential in working with high viscosity viscose since its production rate is not materially changed when using a more dilute viscose solution which gives lower viscosity at the same D.P. Similarly, higher than customary temperatures should be used to reduce the viscosity with little detrimental effects on non-uniformity.

The standard rayon staple machine may be used to spin the above mentioned viscose solutions, however, it is preferred to use the machine disclosed in copending application Ser. No. 39,866, filed May 17, 1979, which was designed specifically for this type of fiber, because of the uniformity of treatment given every fiber in both spinning and subsequent stretching. Further advantages of this new machine are that of $CS_2$ and $H_2S$ recovery, high productivity by spinning with jet clusters and more efficient in the recovery of spent liquor.

Another important feature in the spinning operation for manufacturing the fiber of this invention is the use of a low bath circulation rate, with the overflow from the bath being immediately degassed and filtered before being recycled, as disclosed in said application Ser. No. 39,866. This is desirable from an environmental standpoint and also for the prevention of sulfur compounds (chiefly ZnS) from fouling the bath, jets, guides and acid pipes. The following conditions are preferably used in preparing the filaments of this invention:

| | EXAMPLE 1 | EXAMPLE 2 |
|---|---|---|
| A. Spinning Bath Conditions | | |
| % $H_2SO_4$ | 7.0 | 6.0 |
| % $ZnSO_4$ | 4.0 | 3.0 |
| % $Na_2SO_4$ | 12.0 | 17.0 |
| Temperature | 30 | 40 |
| B. Spinning Conditions | | |
| Speed | 35 M/min. | 30 M/min. |
| Stretch | 135% | 125% |

Following spinning, the continuous filaments are collected in multiple small tows and fed parallel through an enclosed stretch bath, with attendant $CS_2$ removal and recovery, and stretched under the following conditions:

| | EXAMPLE 1 | EXAMPLE 2 |
|---|---|---|
| C. Stretch bath Conditions | | |
| % $H_2SO_4$ | 2-3% | 3.0 |
| Temperature °C. | 90-100 | 95-100 |
| Washing - first wash acidic. | | |

The resultant fiber has the following properties:

EXAMPLE 1

| Fiber Properties | Predicted range Broad | Narrow | Results |
|---|---|---|---|
| Conditioned strength* g/d | 4.5-5.5 | 5.5-5.25 | 5.2 |
| Conditioned Elongation % | 10-20 | 12-15 | 12-15 |
| Wet strength g/d | 2.75-3.5 | 3-3.3 | 3.2 |
| Elongation % | 20-30 | 23-27 | 25 |
| Wet Modulus (g/d at 5% Elong) | 6-10 | 6-8 | 7-9 |
| Caustic solubility (% sol. in 10% NaOH) | 5-7.5 | 5-7.5 | 5.0-7.5 |
| Crimp C.P.I. | 0-10 | 0-10 | 0-10 |
| Shape | round | round | round |

*Standard industry test 11% moisture regain strength and elongation.

EXAMPLE 2

| Fiber Properties | Predicted range Broad | Narrow | Results |
|---|---|---|---|
| Conditioned strength* (g/d) | 4-5 | 4.3-4.7 | 4.5 |
| Conditioned Elongation (%) | 10-20 | 12-18 | 15 |
| Wet strength (g/d) | 2.5-3.25 | 2.8-3.2 | 3.0 |
| Elongation (%) | 20-30 | 23-25 | 2.3 |
| Wet modulus (g/d at 5% elongation) | 7-11 | 7-9 | 7-9 |
| Caustic solubility (% sol. in 10% NaOH) | 5-7.5 | 5-7.5 | 5.0-7.5 |
| Crimp C.P.I. | 20-25 | 20-25 | 20-25 |
| Shape | multilobed | multilobed | multilobed |

*Standard industry test 11% moisture regain strength and elongation.

Thus, in accordance with the present invention, there is provided a viscose rayon fiber having a degree of polymerization of above about 500, preferably 500-650, an alkali solubility below about 7.5% and a tenacity of about 5-6 g/d.

Additionally, the fiber of the present invention may be crimped or non-crimped and each type with a conditioned strength of 4.0-5.5 g/d with a conditioned elongation of 10-20%.

We claim:

1. A process for producing cotton-like rayon filaments having a degree of polymerization above about 500, an alkali solubility below about 7.5%, said alkali solubility being a measure of the percentage of said fiber dissolved in an aqueous solution comprising 10% sodium hydroxide, a tenacity of about 5-6 g/d, a conditioned elongation of 10-20%, a wet strength of 2.5-3.25 g/d, and a wet modulus of 7-9 g/d at 5% elongation, which comprises spinning into a formaldehyde-free bath having an acid concentration of 5.0-8.0% and a zinc salt concentration of 3.0-5.0% at a temperature between about 30°-40° C., a viscose solution prepared by continuously steeping, mercerizing, aging and filtering, said viscose solution being composed of cellulose xanthate in a concentration of 6.0-9.0% with a degree of polymerization of at least 500, and containing an effective amount of modifier, and stretching the resulting filaments 125-135% in a dilute acid bath.

2. The process defined in claim 1, produced by continuously processing a viscose rayon solution prepared from a wood pulp having an α-cellulose content of 1,000 or more.

3. The process defined in claim 1, wherein the degree of polymerization is between 500-650.

* * * * *